US006644296B2

(12) United States Patent
Gardner, Jr.

(10) Patent No.: US 6,644,296 B2
(45) Date of Patent: Nov. 11, 2003

(54) DYNAMIC PAINTBALL GUN CONTROL

(75) Inventor: William M. Gardner, Jr., Ligonier, PA (US)

(73) Assignee: Smart Parts, Inc.

( * ) Notice: Subject to any disclaimer, the term of this patent is extended or adjusted under 35 U.S.C. 154(b) by 0 days.

(21) Appl. No.: 10/115,265

(22) Filed: Apr. 2, 2002

(65) Prior Publication Data

US 2002/0170552 A1 Nov. 21, 2002

Related U.S. Application Data

(60) Provisional application No. 60/292,542, filed on May 21, 2001.

(51) Int. Cl.[7] ..... F41B 11/00; F41B 11/32

(52) U.S. Cl. ..... 124/77; 124/56

(58) Field of Search ..... 124/56, 71, 72, 124/73, 74, 75, 76, 77, 69, 70

(56) References Cited

U.S. PATENT DOCUMENTS

| | | | | | |
|---|---|---|---|---|---|
| 2,304,320 | A | | 12/1942 | Tratsch | 124/11 |
| 2,554,116 | A | | 5/1951 | Monner | 124/11 |
| 2,568,432 | A | | 9/1951 | Cook | 124/13 |
| 2,594,240 | A | | 4/1952 | Wells | 124/13 |
| 2,634,717 | A | | 4/1953 | Junkin | 124/11 |
| 2,834,332 | A | | 5/1958 | Guthrie | 124/13 |
| 2,845,055 | A | | 7/1958 | Collins et al. | 124/11 |
| 3,089,476 | A | | 5/1963 | Wolverton | 124/11 |
| 3,192,915 | A | | 7/1965 | Norris et al. | 124/11 |
| 3,662,729 | A | | 5/1972 | Henderson | 124/11 |
| 3,695,246 | A | | 10/1972 | Filippi et al. | 124/11 |
| 3,739,764 | A | * | 6/1973 | Allport | 124/70 |
| 3,921,980 | A | | 11/1975 | Artzer | 273/101 |
| 4,094,294 | A | | 6/1978 | Speer | 124/56 |
| 4,362,145 | A | | 12/1982 | Stelcher | 124/32 |
| 4,770,153 | A | | 9/1988 | Edelman | 124/72 |
| 4,819,609 | A | | 4/1989 | Tippmann | 124/72 |
| 4,899,717 | A | | 2/1990 | Rutten et al. | 124/67 |
| 4,936,282 | A | | 6/1990 | Dobbins et al. | 124/74 |
| 4,951,644 | A | * | 8/1990 | Bon | 124/75 |
| 5,081,901 | A | * | 1/1992 | Kemeny et al. | 89/8 |
| 5,228,427 | A | | 7/1993 | Gardner, Jr. | 124/71 |
| 5,280,778 | A | | 1/1994 | Kotsiopoulos | 124/73 |
| 5,285,765 | A | | 2/1994 | Lee | 124/50 |
| 5,333,594 | A | | 8/1994 | Robinson | 124/73 |
| 5,383,442 | A | | 1/1995 | Tippmann | 124/76 |
| 5,413,083 | A | | 5/1995 | Jones | 124/32 |
| 5,613,483 | A | | 3/1997 | Lukas et al. | 124/73 |
| 5,727,538 | A | * | 3/1998 | Ellis | 124/77 |
| 5,878,736 | A | | 3/1999 | Lotuaco, III | 124/71 |
| 5,881,707 | A | | 3/1999 | Gardner, Jr. | 124/77 |
| 5,967,133 | A | | 10/1999 | Gardner, Jr. | 124/77 |
| 6,003,504 | A | | 12/1999 | Rice et al. | 124/73 |
| 6,035,843 | A | | 3/2000 | Smith et al. | 124/77 |
| 6,062,208 | A | * | 5/2000 | Seefeldt et al. | 124/71 |
| 6,142,137 | A | * | 11/2000 | MacLaughlin | 124/72 |
| 6,311,682 | B1 | * | 11/2001 | Rice et al. | 124/71 |
| 6,349,711 | B1 | * | 2/2002 | Perry et al. | 124/73 |
| 6,378,367 | B1 | * | 4/2002 | Dilz, Jr. | 73/488 |
| 6,439,216 | B1 | * | 8/2002 | Johnson et al. | 124/70 |
| 6,474,325 | B2 | * | 11/2002 | Rice et al. | 124/71 |
| 2003/0085523 | A1 | * | 5/2003 | Spaulding et al. | 273/317 |

* cited by examiner

*Primary Examiner*—Charles T. Jordan
*Assistant Examiner*—John W. Zerr
(74) *Attorney, Agent, or Firm*—Marger Johnson & McCollom, P.C.

(57) ABSTRACT

A paintball gun control system according to this invention includes an electronic circuit board configured to receive a sensor signal corresponding to a measured value of a paintball gun characteristic. The circuit board compares the measured value with a desired value. Based upon that comparison, the circuit board adjusts one or more characteristics of the paintball gun to bring the measured value into conformity with the desired value.

15 Claims, 2 Drawing Sheets

DYNAMIC PAINTBALL GUN CONTROL

This application claims priority from U.S. Provisional Patent Application Serial No. 60/292,542, filed May 21, 2001, the contents of which are incorporated herein by reference in their entirety.

FIELD OF THE INVENTION

This invention relates generally to pneumatic paintball guns. More specifically, this invention relates to pneumatic paintball guns that use electronic circuitry to control one or more paintball gun operations.

BACKGROUND OF THE INVENTION

Until recently, paintball was played with purely mechanically-operated pneumatic guns. With the introduction of electro-pneumatic paintball guns, such as described in U.S. Pat. Nos. 5,881,707; 5,967,133; and 6,035,843, however, a new age in paintball technology was born. Along with electronic control came the ability to precisely control the timing of gun operations. Precise electronic timing allowed problems with ball chopping and blow back to be overcome, thus permitting much higher firing rates than previously considered possible. The electronic circuitry also made it possible to program these paintball guns with varying firing rates such as semi-auto, 3 or 6 shot bursts, turbo, and even full-auto. In addition, the extremely light triggers made possible by use of a trigger-actuated microswitch made it possible for users to easily reach high firing rates even in pure semi-automatic mode. Unfortunately, however, higher firing rates have introduced a new range of problems.

One of these problems is inconsistent shot-to-shot paintball velocities. In the sport of paintball, it is desirable to maintain as consistent a paintball velocity as possible. In both recreational and tournament play, a maximum velocity for paintballs launched from the paintball gun is mandated. If a player uses a gun that fires above this velocity, it is considered to be shooting "hot" and the player using it will be disqualified. At the same time, however, if a player uses a paintball gun that fires at too low a velocity, both the distance that the paintball will travel and the speed with which it will travel toward its intended target will be diminished. The player will therefore be left at a serious disadvantage compared to players whose guns are firing nearer the maximum permitted velocity. Inconsistency between shot-to-shot velocities also makes it hard for a player to plan his/her shots. It is therefore desirable to have shot-to-shot velocities that are consistent and predictable.

Several factors affect the consistency of the paintball velocity between shots. Particularly with respect to guns which use $CO_2$, but also to some extent with respect to guns using nitrogen or compressed air as the propellant, a drop in velocity between shots (or "shoot down") can result during rapid firing because the chamber ("gas storage chamber") storing compressed gas for launching the paintball will not have adequate time to fill up to the desired pressure. This problem has been exacerbated in electronic paintball guns because of the high fire rates that are easily obtainable. Fortunately, in most electrically controlled paintball guns, dwell settings are available to control both the "on" time of a firing pulse, as well as an "off" time, or delay between shots. These settings can be predetermined in order to maximize consistency of velocity by permitting adequate time between shots for the compressed gas storage chamber to fill to the necessary pressure.

Using predetermined dwell settings, however, does not provide dynamic adaptation to respond to decreasing gas supply pressures, temperature changes, irregularities caused by poor regulator supplies, or other gun characteristics that can alter the velocity with which the paintballs are expelled. It would be desirable to have a way to automatically adapt the paintball gun to varying gun characteristics to permit a more consistent shot-to-shot velocity. It would also be desirable to dynamically measure and control paintball gun characteristics to improve other aspects of performance of the paintball gun.

SUMMARY OF THE INVENTION

An object of this invention is to provide a system and method for dynamically sensing and adjusting paintball gun characteristics to improve paintball gun operation, such as by providing a more consistent shot-to-shot velocity.

According to a preferred aspect of this invention, one or more characteristics related to the velocity of a paintball gun are determined during operation of the paintball gun and relayed to an electronic circuit. The electronic circuit dynamically adjusts one or more operational characteristics of the paintball gun to permit consistent shot-to-shot velocities. In other words, a feedback loop is integrated into the paintball gun to enable dynamic measurement of velocity or a velocity related characteristic and to provide feedback to the gun to allow it to regulate its own velocity to correspond to a desired velocity. In this way, consistent shot-to-shot velocity of the paintball gun is provided regardless of variations in shot rate, temperature, or other internal or external factors.

Alternatively, paintball gun characteristics related to other operational parameters of the paintball gun could be dynamically measured and controlled to improve paintball gun operation. Among other things, firing rate could be optimized based on a firing history of the paintball gun and a dynamically determined present firing rate. Temperature sensors could be used to measure a current temperature and dynamically adjust gun parameters based thereon. A loading sensor could be used to identify loading problems and dynamically adjust solenoid valve dwell settings where necessary to ensure a sufficient load time. Still other uses for the dynamic feedback loop of this invention will be apparent to those skilled in the art.

BRIEF SUMMARY OF THE DRAWINGS

The foregoing and additional objects and advantages of the present invention will become more readily apparent through the following detailed description of preferred embodiments, made with reference to the accompanying drawings, in which.

DETAILED DESCRIPTION OF PREFERRED EMBODIMENTS

According to a preferred embodiment, the velocity of a paintball exiting a paintball gun can be determined in several ways, both direct and indirect. Once the velocity of the paintball is known, various paintball gun characteristics can be modified to either increase or decrease the velocity of the next shot in order to conform to a desired velocity.

Figure 1:
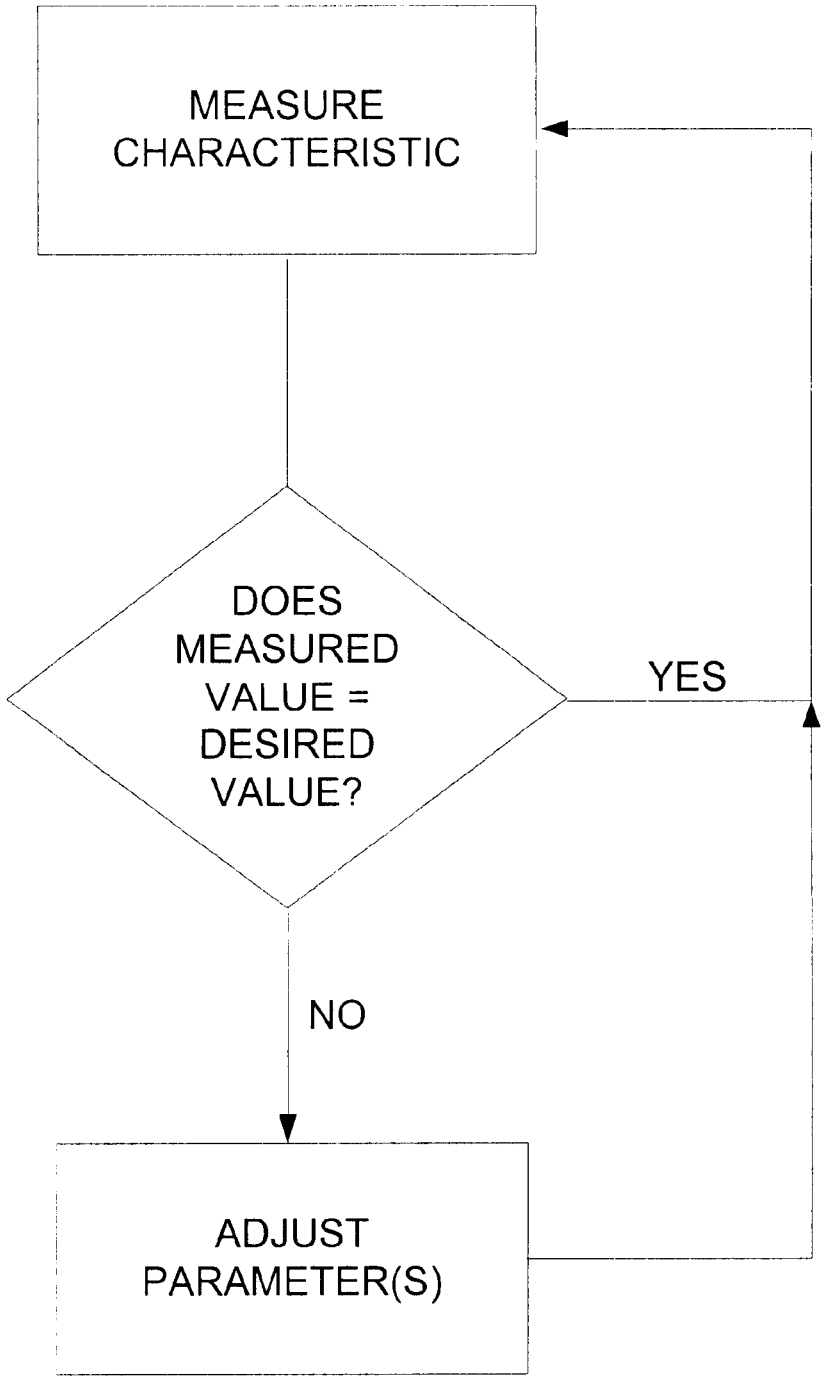
FIG. 1 is a flow chart illustrating a method of dynamically controlling the velocity at which a paintball is launched from a paintball gun based on one or more measured gun characteristics.

Referring to FIG. 1, a method for dynamically controlling a paintball gun is as follows. A sensor measures and sends a signal corresponding to a measured paintball gun characteristic value to an electronic circuit board of the paintball gun. The circuit board compares the measured value with a desired value. Based upon that comparison, the circuit board adjusts one or more parameters of the paintball gun to bring the measured value into conformity with the desired value.

To obtain a consistent shot-to-shot velocity, for instance, a preferred method proceeds as follows. First, velocity itself or a velocity-related characteristic is measured to obtain a measured value. The measured value is then compared to a desired value or range. An appropriate gun parameter(s) is then adjusted to bring the measured value toward its desired value. This process can be repeated to correctly adjust the measured value to conform to the desired value or range. Characteristics that can be measured include the velocity itself, regulated pressure (chamber pressure), and any other characteristic related to velocity. Parameters that can be adjusted to provide consistent velocity include solenoid dwell settings, chamber pressure, and other parameters that can be used to adjust velocity to a target level.

A paintball's velocity can be measured directly, for instance, using a chronograph or other type of speed detector. In one embodiment of the invention, for instance, a laser (or other light or sound beam) is used to calculate the paintball's velocity. After determining the paintball velocity, a signal representing that velocity is sent to the gun's electronic circuit board. The electronic circuit board contains circuitry that allows the detected velocity to be compared with a desired velocity. The circuit board can then determine which of the paintball gun's parameters need to be altered, and to what extent, in order to conform the detected velocity to the desired velocity.

Once it has been determined which parameter(s) needs to be adjusted, signals are sent from the circuit board to various other parts of the paintball gun's electronic circuitry to cause that parameter(s) to be appropriately adjusted. If, for instance, the circuit board determines that the velocity of the shot is too low, the circuit board may adjust the solenoid "off" time to permit a longer time for the compressed gas storage chamber to fill. If, on the other hand, the circuitry determines that the velocity is too high, the pressure regulator may be adjusted to reduce the amount of pressure supplied to the compressed gas storage chamber.

Paintball velocity can also be determined indirectly by measuring gun characteristics that bear a relationship to the velocity of the paintball. These characteristics can be those that cause the paintball to have a certain velocity, or they can be characteristics that result from velocity. The firing pressure, or pressure within the storage chamber containing the gas with which the ball is expelled, for example, has a direct bearing on the velocity with which the paintball will leave the gun. Other gas pressures within the gun may also bear a relationship to that firing pressure and could therefore also be used to determine velocity.

In embodiments based on this principle, for example, a pressure transducer can be located within a pressurized area of the paintball gun wherein the pressure bears a determinable relationship with the velocity of a shot. The transducer determines a pressure within that area and transmits a signal corresponding to that pressure to the electronic circuit board. The circuit board compares the measured pressure of that area with a predetermined pressure corresponding to the desired velocity. Based on this comparison, the circuit board determines which gun parameter(s) needs to be adjusted to obtain the appropriate chamber pressure, and hence the desired velocity. The parameters that can be adjusted include the dwell settings and the pressure supplied by the pressure regulator, as well as any other parameter that can reduce or increase the chamber pressure before a shot.

Figure 2:
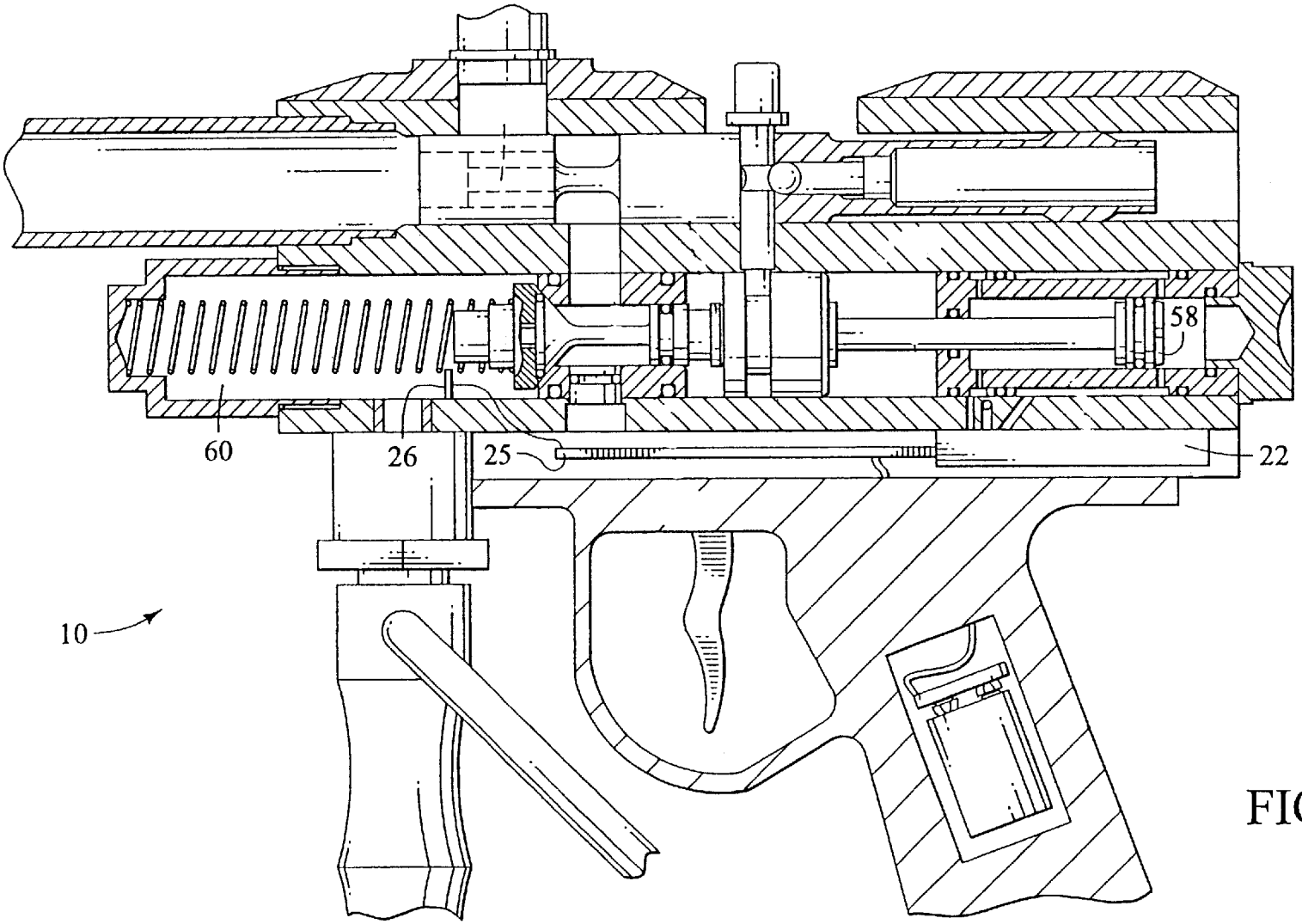
FIG. 2 is a cross-sectional side view of a paintball gun showing a sensor location for dynamically measuring velocity-related paintball gun characteristics according to one embodiment of the present invention.

Referring to FIG. 2, according to one preferred such embodiment, a pressure transducer 26 is mounted in the compressed gas storage chamber 60 of a paintball gun 10. The pressure transducer 26 measures the pressure of gas in the storage chamber before a firing operation. The sensed pressure value is sent to a circuit board 25, having circuitry that compares the measured pressure value with a predetermined pressure value known to produce the desired velocity. The pressure inside the compressed gas storage chamber 60 is then automatically adjusted to correspond to the predetermined pressure. To accomplish this, the dwell settings for operating the solenoid valve 22 are preferably modified to allow the chamber 60 more or less time to fill, as appropriate. Alternatively, the pressure regulator (not shown) can be dynamically adjusted to supply gas at a higher or lower pressure, as desired.

The sound created by a shot also bears a relationship to the velocity of a shot from the paintball gun. In another embodiment, therefore, the sound of the shot can be used to determine the paintball velocity. To use sound, one or more electro-acoustic transducers are configured to measure and analyze a resonant frequency or frequencies that bear a direct relationship to the velocity of the paintball being expelled from the gun. Similar to the embodiments described previously, the measured acoustic characteristics of a shot are compared to the acoustic characteristics of a shot having the proper velocity. The circuitry then determines which gun parameters need to be changed to bring the measured acoustic characteristic values in line with the desired acoustic characteristic values. Signals are then sent to necessary parts of the circuitry to adjust those gun parameters as desired. As before, the dwell settings or other parameters of the paintball gun can be automatically adjusted based on the acoustic properties of the shot in order to obtain consistency between shot-to-shot velocities.

Although the forgoing description primarily addresses dynamic control of paintball velocity by aligning measured values with desired values, feedback loops could also be used, however, to select desired operating modes and other characteristics of the paintball gun using dynamic measurements. Short-term or long-term operational trends of the gun (in general or with respect to a specified user) could also be used in conjunction with the dynamic measurements to control paintball gun performance.

In particular, feedback loops such as that described above with respect to FIG. 1 can be used to dynamically measure and control other paintball gun characteristics, whether or not related to paintball velocity. Tank pressure, gun input pressure, pressure(s) for operating solenoid valve(s), valve dwell settings, and many other parameters can be dynamically controlled in response to measured gun characteristics.

More specifically, feedback loops could be used, for example, to select an appropriate firing mode (such as semi-auto, burst mode, or full auto) based on the recent or long-term shot history of the paintball gun and the present firing rate. Feedback loops could also be used to dynamically control battery conservation features on the paintball gun. The length of delay before entering a sleep mode, for example, could be controlled automatically based on gun history. When the delay time is equal to the desired delay time, the circuit board could instruct the gun to enter a sleep mode. Temperature sensors could be used to measure a current temperature and dynamically adjust gun parameters based thereon. A loading sensor could be used to identify loading problems and dynamically adjust solenoid valve dwell settings, agitator settings on the loader, or other settings to improve loading characteristics. Still other uses for the electronic feedback loop in a paintball gun of this invention will be apparent to those skilled in the art.

Having described and illustrated the principles of the invention with respect to various preferred embodiments thereof, it should be apparent that the invention can be modified in arrangement and detail without departing from such principles. I therefore claim all modifications and variations coming within the spirit and scope of the following claims.

What is claimed is:

1. An electronic paintball gun, comprising:

an electronic circuit board;

a sensor configured to permit determination of a velocity of a painthall exiting a paintball gun and to cause a signal corresponding to the velocity to be sent to the electronic circuit board; and said electronic circuit board configured to control one or more operational parameters of a solenoid in response to the determined velocity.

2. A paintball gun according to claim 1, wherein the sensor is configured to measure a pressure within a compressed gas storage chamber.

3. A paintball gun according to claim 2, wherein the electronic circuit board is adapted to compare the measured chamber pressure with a desired chamber pressure.

4. A paintball gun according to claim 1, wherein the electronic circuit board is configured to adjust a dwell setting of the solenoid.

5. A paintball gun according to claim 1, wherein the velocity is dynamically measured and controlled during paintball gun operation in order to maintain consistent shot-to-shot velocities.

6. A paintball gun according to claim 1, wherein the sensor is configured to measure a velocity of a paintball exiting a barrel of the paintball gun.

7. A paintball gun according to claim 6, wherein the electronic circuit board is configured to compare the measured velocity with a desired velocity range.

8. A paintball gun according to claim 7, wherein the electronic circuit board is further configured to cause the measured velocity to fall within the desired velocity range.

9. A paintball gun according to claim 8, wherein the electronic circuit board is configured to adjust a dwell setting of the solenoid to increase the measured velocity.

10. A dynamic control circuit for a paintball gun, said circuit comprising:

means for determining a velocity of a paintball exiting a paintball gun;

means for comparing the determined velocity to a desired velocity; and means for adjusting a delay between shots of the paintball gun to cause the velocity to substantially conform to the desired velocity.

11. A dynamic control circuit according to claim 10, wherein the means for determining comprises a sensor.

12. A dynamic control circuit according to claim 10, wherein the means for comparing comprises an electronic circuit board.

13. A dynamic control circuit according to claim 10, wherein the means for adjusting comprises an electronic circuit board.

14. A dynamic control circuit according to claim 11, wherein the sensor is configured to measure a pressure.

15. A dynamic control circuit according to claim 14, wherein the means for adjusting is configured to control a dwell setting of a solenoid of the paintball gun to cause the measured pressure value to conform to a desired pressure value.

* * * * *

UNITED STATES PATENT AND TRADEMARK OFFICE

CERTIFICATE OF CORRECTION

PATENT NO. : 6,644,296 B2
DATED : November 11, 2003
INVENTOR(S) : Gardner, Jr.

It is certified that error appears in the above-identified patent and that said Letters Patent is hereby corrected as shown below:

Column 5,
Line 23, “a painthall exiting” should read -- a paintball exiting --.

Signed and Sealed this

Twenty-seventh Day of July, 2004

JON W. DUDAS
*Acting Director of the United States Patent and Trademark Office*